US007841427B2

(12) United States Patent
Shamburger et al.

(10) Patent No.: US 7,841,427 B2
(45) Date of Patent: Nov. 30, 2010

(54) OPTIMIZED CENTRAL PDC CUTTER AND METHOD

(75) Inventors: James Shamburger, Spring, TX (US); Vincent Salvo, Spring, TX (US)

(73) Assignee: Omni IP Ltd., Tortola (VG)

( * ) Notice: Subject to any disclaimer, the term of this patent is extended or adjusted under 35 U.S.C. 154(b) by 60 days.

(21) Appl. No.: 12/218,832

(22) Filed: Jul. 18, 2008

(65) Prior Publication Data

US 2010/0012388 A1 Jan. 21, 2010

(51) Int. Cl.
*E21B 10/36* (2006.01)

(52) U.S. Cl. ..... 175/341; 175/431

(58) Field of Classification Search ..... 175/341, 175/431, 434

See application file for complete search history.

(56) References Cited

U.S. PATENT DOCUMENTS 3,720,273 A * 3/1973 McKenry et al. ..... 175/335
4,907,662 A * 3/1990 Deane et al. ..... 175/431
5,074,729 A * 12/1991 Oba ..... 411/387.8
6,315,066 B1 * 11/2001 Dennis ..... 175/431

* cited by examiner

*Primary Examiner*—William P Neuder
(74) *Attorney, Agent, or Firm*—The Matthews Firm

(57) ABSTRACT

A drill bit, insert and method useful for subterranean drilling, or forming boreholes in subterranean formations is provided. More particularly, a more efficient cutting structure and method is provided in the central portion of a PDC drill bit. The present invention provides a drill bit, insert and method having a central cutting portion with a more normalized angle of attack. The drill bit of the present invention provides for various attack angles much closer to the optimum side rake.

23 Claims, 17 Drawing Sheets

OPTIMIZED CENTRAL PDC CUTTER AND METHOD

FIELD OF THE INVENTION

The present invention relates generally to drill bits useful for subterranean drilling, or forming boreholes in subterranean formations. More particularly, the invention relates to replacing the central cutters of a drill bit, particularly a PDC drill bit, with a more efficient cutting structure. Even more particularly, the invention relates to a drill bit having a central cutting portion with a more normalized angle of attack. The drill bit providing the various attack angles much closer to the optimum attack angle for the particular situation.

BACKGROUND OF THE INVENTION

PDC (Polycrystalline Diamond Compact) bits were introduced in the oil and gas industry in the mid 1970s. During the past 30 years, numerous technological improvements brought to the PDC cutters and bits have enabled them to take an important and growing share of the drilling bit market. In 2003, about 50% of the total footage drilled was with PDC bits compared to 26% in 2000. Further in 2003, the total revenue of PDC bits sales was around $600 million.

It has been difficult to extend the application of PDC bits in harder and more abrasive formations even with significant improvements. PDC bits have had improvements in bit hydraulics, tougher and more abrasion resistant PDC cutters and dynamic stability of PDC bits has resulted in continuously and significantly increasing the average rate of penetration (ROP) and bit life of PDC bits. Even such improvements have failed to extend the application of PDC bits in harder and more abrasive formations. Therefore historically, the use of PDC bits has been restricted to soft to medium and nonabrasive formations. A particular concern is the inability of a PDC bit to cut effectively, if at all, at the center of the drill bit.

Many improvements have been made in the quality and variety of the cutters and in new manufacturing techniques to prevent cutter wear and breakage. The improvements have, for example, focused on providing better impact and abrasion resistant diamond material and the interface geometry between the diamond layer and the tungsten carbide substrate. With the numerous innovations and technological breakthroughs, PDC bits drill faster, better and deeper, extending their application in harder and more abrasive formations, but a basic problem remains, the high inefficiency of the central cutters of the bit.

PDC bits, as opposed to roller cone bits, have no moving parts. The body of a PDC bit is typically manufactured from two different materials, steel bodied and matrix bodied bits. The steel bodied bit, machined and manufactured with steel stock, is better able to withstand impact load than matrix bodied bits. Steel bodied bits are generally preferred for soft and nonabrasive formations and large hole size. The main disadvantage of steel is that it is less erosion resistant than matrix and, consequently, more susceptible to wear by abrasive fluids. To reduce the bit body erosion, bits are "hard-faced" with a coating material that is more erosion resistant, and sometimes receives an anti-balling treatment for very sticky rock formations such as shales. Matrix bits are manufactured with tungsten carbide, which is more erosion resistant than steel. The matrix bits are preferred when using high solid-content drilling mud.

Typically, the PDC cutters are composed of a thin layer of polycrystalline diamond bonded to a cemented tungsten carbide substrate. The thin layer of polycrystalline diamond is up to approximately 3.5 mm thick. These PDC cutters are generally cylindrical with a diameter generally from about 8 mm up to about 24 mm. These PDC cutters may be available in other forms such as oval or triangle-shaped and are generally chamfered to increase the cutter's impact resistance.

Improvements have been made in the quality and variety of the cutters and in new manufacturing techniques to prevent cutter wear and breakage. In one aspect, these improvements concern a better impact and abrasion resistant diamond material. The interface geometry between the diamond layer and the tungsten carbide substrate are also improved. Due to the thermal limitations of the PDC bit wherein above 700° C. the diamond layer disintegrates as a consequence of cobalt expanding, much work has been done to produce a Thermally Stable Polycrystalline (TSP) cutter. It is desirable to have a TSP cutter that is stable up to 1,150° C. Thus, PDC bits have thermal limitations at temperatures above about 700° C. One of the reasons that a PDC cutter is so difficult to achieve is the lack of cutting efficiency at the center of the PDC bit.

Cutters are attached to the bit body using an alloy that must have the lowest possible melting point, good flow properties, excellent wettability and shear strength and bond well to tungsten carbide at low temperatures. The brazing is a critical operation in PDC bit manufacturing and silver is the predominant element. The highly controlled chemistry of the silver is necessary to provide the strength needed to braze the cutting elements to the matrix bit body. Thus, the matrix bit body is able to translate weight and rotation to the cutting structure. Due to the physical structure of a PDC bit, the cutters cannot be arranged to cover, and thus cut, the formation at the center of the bit.

PDC bits drill the rock formation by shearing, like the cutting action of a lathe, as opposed to roller cone bits that drill by indenting and crushing the rock. The PDC bit's cutting action plays a major role in the amount of energy needed to drill a rock formation, and can be modeled by studying the interaction between a single PDC cutter and the rock formation. Many models have been developed during the past 30 years to predict the forces on the PDC bit. The single cutter-rock models generally take into account the PDC cutter characteristics (cutter size, back rake angle, side rake, chamfer, etc.) and the rock mechanical properties to calculate the forces necessary to cut an amount of rock. The 2D or 3D rock-bit interaction model takes into account the bit characteristics (profile, cutter layout, gauges) and the bit motion to calculate the Weight On Bit (WOB), Torque On Bit (TOB) and side force on the bit at given operating conditions in a given rock formation, either isotropic or heterogeneous formations. Laboratory single-cutler tests and full scale PDC bit tests have been carried out at atmospheric pressure or under bore-hole conditions and tend to validate these models, enabling many advances made in bit design and optimization.

The design of a PDC bit is largely a compromise between many factors, such as, drillability, ROP, hydraulics, steerability and durability. Typically, the design emphasizes the three parts of the PDC bit that interacts with the rock formation: the cutting structure (bit profile and cutter layout characteristics), the active guage (guage cutters or trimmers), and the passive guage (guage pads). There are three basic types of PDC bit profile: flat or shallow cone, tapered or double cone and parabolic, according to IADC fixed cutter drill bit classification there are nine bit profile codes. The type of profile plays an important role for the bit stability and durability and bit directional responsiveness. The choice of bit profile depends on the type of application, and it is difficult to give or apply general rules. Nevertheless, it is generally thought that the bit cone tends to make the bit more stable and that very flat profiles are generally used for sidetrack applications.

The active gauge formed by the PDC's truncated-at-bit diameter constitutes the transition zone between the cutting zone and the positive gauge. These trimmers can be pre-flattened or rounded. The passive gauge or gauge pad plays an important role in the stability and in the directional responsiveness of the PDC bit. The passive gauge is reinforced by tungsten carbide inserts, diamonds or TSP to maintain the full gauge diameter of the drilled hole.

PDC bit drillabiity is certainly the most important factor affecting global drilling costs. The PDC cutter characteristics, back rake angle, cutter layout, cutter count and cutter size are the main parameters that control the drillability of the bit. The back rake angle is defined as the angle the cutter face makes with respect to the rock. The back rake angle controls how aggressively cutters engage the rock formation. Generally, as the back rake is decreased, the cutting efficiency increases, i.e., high ROP, however the cutter becomes more vulnerable to impact breakage. A large back rake angle will result in lower ROP but will typically result in a longer PDC bit life. Also, the side rake angle generally affects the cleaning of the cutters, as it helps to direct the cutting toward the periphery of the bit.

PDC cutter count and size are selected for a specific formation under specific operating conditions. The general rule is that small cutters and high cutter count are chosen for hard and abrasive rock formation, whereas large cutters and a reduced cutter count are preferred for soft to medium formation. Typically, the cutter count determines the number of blades required.

PDC bit stability is extremely important for the global drilling performance. A stable bit increases rate of penetration and bit life, improves hole quality and reduces the damage caused to downhole equipment. The three main vibration modes are axial resulting in bit bouncing, torsional resulting in stick-slip; and lateral resulting in whirl motions. Considerable research in PDC bit dynamics has led to balanced PDC bits minimizing the imbalance forces. In particular, the use of spiraled blades has increased PDC bit dynamics. Other techniques are anti-whirl bits, low-friction gauge pads, and full gauge contact design to make the bits more stable. A widely spread innovation consists in placing some impact arrestors or small round inserts behind the PDC cutters, which provide a better stabilization to axial and lateral modes of vibration.

The steerability of a bit corresponds to the ability of the bit to initiate a deviation. For example, high steerability for a bit implies a strong propensity for deviation, enabling a maximum dogleg potential. Generally speaking, and all things being equal, the short-gauge design is more steerable than long-gauge design, but may lead to poor borehole quality. To enhance toolface control during the sliding phase of a mud motor, some PDC bits have been designed to control lateral and axial aggressivity. This enables the directional drifter to control a PDC bit.

Advancements in PDC cutter technology have increased the development and performance of PDC bits. Cutters have mainly been evaluated in terms of their resistances to impact and abrasion because the primary reasons of bit failure are abrasive damage and impact loading damage. Additionally, other characteristics such as interface strength, thermal stability and fatigue are also analyzed. Maximizing these properties improves cutter durability that subsequently enhances PDC bit performance and drilling efficiency.

The size of nozzles made of tungsten carbide that are interchangeable depends on many factors, with the main factors being the size of the bit and the recommended hydraulic program. The bit hydraulic is fundamental for two main purposes. First, the drilling mud cleans the cuttings from the bit and prevents bit balling. Secondly, the mud cools the cutters to maintain the temperature below the critical 700° C. The conventional nozzles are circular and create a symmetric pressure distribution at the rock interface. Some improvements have been the development of nozzles with non-circular or fluted jets with specialized interior shapes. This enables a more efficient cleaning and cutter removal with increased turbulence under the bit resulting in a higher ROP. Computational fluid dynamics programs enable modeling of the fluid flow around bits inside a borehole to investigate quickly many bit designs and optimize fluid flow.

Typically, a PDC bit is designed for a specific application, depending mainly upon the rock formation to be drilled. It is therefore important to study the type of rock encountered during drilling using data and logs from offset wells. The mechanical and physical characteristics of the formation such as compressive strength, abrasiveness, elasticity, stickiness and pore pressure govern the choice of the PDC bit to be used. Design software can estimate rock strength from well logs and evaluate PDC bit performance to help in drilling bit selection. At the same time, drilling parameters or hydraulic aspects should also be studied to adjust the bit design.

PDC bits are also chosen for the type of application: directional drilling, slim hole, horizontal, motor drilling, turbo-drilling, reaming drilling, etc. Most bit manufacturers have their own line of PDC bits for rotary steerable systems (RSS), their own specialized PDC bits for drilling salt or shales, or for any particular application. The objective is always the same: to drill as fast as possible in a smooth way, and terminate the run with minimum wear to reduce overall drilling costs.

A feature of the present invention is to provide a PDC drill bit having a high efficiency for the central cutters of the bit.

Another feature of the present invention is to provide a PDC drill bit having an efficient angle with respect to attacking the portion of the formation central to the bit.

Another feature of the present invention is to provide a PDC drill bit that drills the formation at the center portion of the bit as well as at the extreme portions of the bit.

Another feature of the present invention is to provide a PDC drill bit that improves the drilling efficiency in the center of the bit.

Another feature of the present invention is to provide a PDC drill bit that increases the efficiency of the central cutters of a bit.

Another feature of the present invention is to replace the central cutters of a PDC bit with a more efficient cutting structure.

Yet another feature of the invention is to a PDC drill bit having a more efficient central cutting structure with a more normalized angle of attack.

Another feature of the present invention is to a PDC drill bit having a more efficient central cutting structure with an aggressive side rake angle.

Yet another feature of the present invention is to provide a method of drilling having more efficient central cutting structure.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

To achieve the foregoing objects, features, and advantages and in accordance with the purpose of the invention as embodied and broadly described herein, a PDC drill bit, insert and method is provided.

A PDC drill bit for subterranean drilling or forming boreholes in subterranean formations is provided. The PDC drill bit comprises a drill bit body, a central cutting member for enhancing the efficiency of the PDC bit at the center of the drill bit body. The central cutting member comprises an end portion for engaging the drill bit body, a member adjacent the end portion, and a plurality of cutters supported by the member. The plurality of cutters comprises a plurality of protrusions and a cutting surface on each protrusion. The cutting surface comprising a side rake angle that is aggressive. Alternately, the cutting surface comprises a side rake angle of approximately −15 degrees to 15 degrees. And alternately, the plurality of cutters is immediately adjacent to and overlapping the center of the PDC drill bit.

In another embodiment of the present invention, a method for enhancing the efficiency of a PDC bit at the center of the drill bit body is provided. The method comprising the steps of engaging central cutters with the PDC bit, providing the central cutters with a more efficient cutting structure, and providing a side rake angle of approximately zero with respect to the central cutters for enhancing the efficiency of the PDC bit at the center of the drill bit body. The step of providing a side rake angle that is aggressive with respect to the central cutters. Further, the present invention comprises the step of providing a side rake angle within the range of approximately −15 degrees to 15 degrees. The step of providing the central cutters with a more efficient cutting structure further comprises the step of placing a plurality of cutters immediately adjacent to and overlapping the center of the PDC drill bit.

In yet another embodiment of the present invention, an insert for a PDC drill bit for subterranean drilling or forming boreholes in subterranean formations is provided. The insert for a PDC drill bit comprises an end portion for engaging the PDC drill bit at the center of the drill bit and a plurality of cutters supported by the end portion. The plurality of cutters comprises a plurality of protrusions, and a cutting surface on each protrusion. The cutting surface comprising a side rake angle that is aggressive. Alternately, the insert for a PDC drill bit comprises the plurality of cutters and the end portion are a unitary structure. In another embodiment of the present invention, the cutting surface on each protrusion comprises a side rake angle within the range of approximately −15 degrees to 15 degrees. In yet another embodiment of the present invention, the plurality of cutters are immediately adjacent to and overlapping the center of the PDC drill bit.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

BRIEF DESCRIPTION OF THE DRAWINGS

The accompanying drawings which are incorporated in and constitute a part of the specification, illustrate preferred embodiments of the invention and together with the general description of the invention given above and the detailed description of the preferred embodiment given below, serve to explain the principles of the invention.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

As identified above, there exists a long-standing problem in bit design associated with the central cutters of any bit—that is the great inefficiency of the central cutters. Due to the working size of the actual cutters, the position of the central cutters is forced into a very inefficient angle with respect to attacking the formation. These problematic side rake angles are such that the bits drill the formation more slowly in the center of a bit compared to the other surfaces of the bit, and in some cases, the center of a bit does not drill at all.

In soft to moderately hard rock, the high inefficiency of the central cutters of the bit does not pose a significant issue. However, in the hard, abrasive sandstone, such as for example, of the Travis Peak formation has shown that an advantage can be gained by improving drilling efficiency in the center of the bit.

Figure 1:
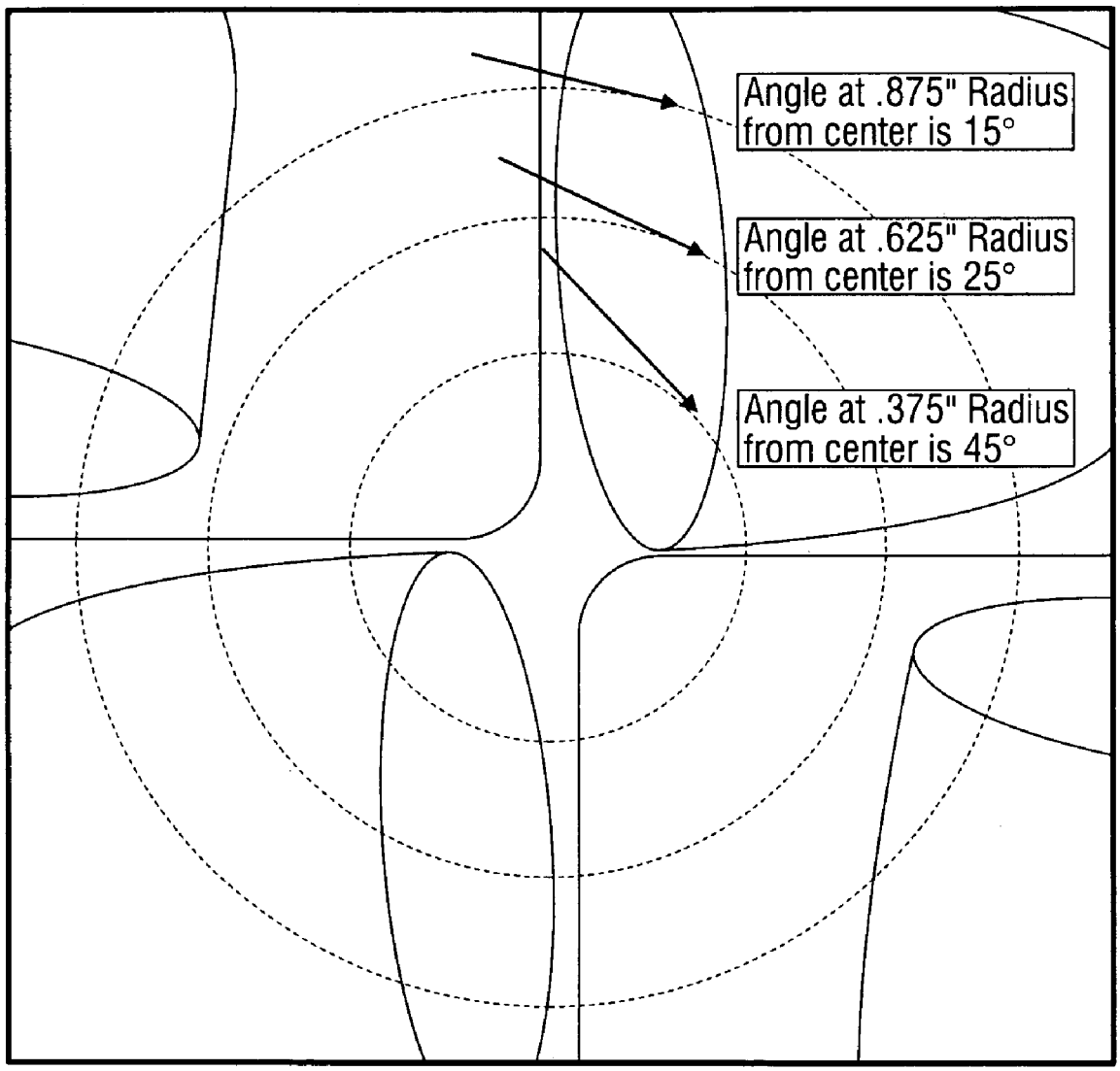
FIG. 1 PRIOR ART
FIG. 1 is an illustration of a prior art drill bit illustrating that the angle of attack is very inefficient for removing formation in the central cutters with respect to direction of rotation.

FIG. 1 is an illustration of a prior art drill bit illustrating that the angle of attack is very inefficient for removing formation in the central cutters with respect to direction of rotation. In a hard rock formation, it is readily apparent that drilling is problematic and even bit damage is possible due to central inefficiency. Thus there is a long felt need for a drill bit and method of drilling that increases the efficiency of the central cutters of a bit.

Figure 2:
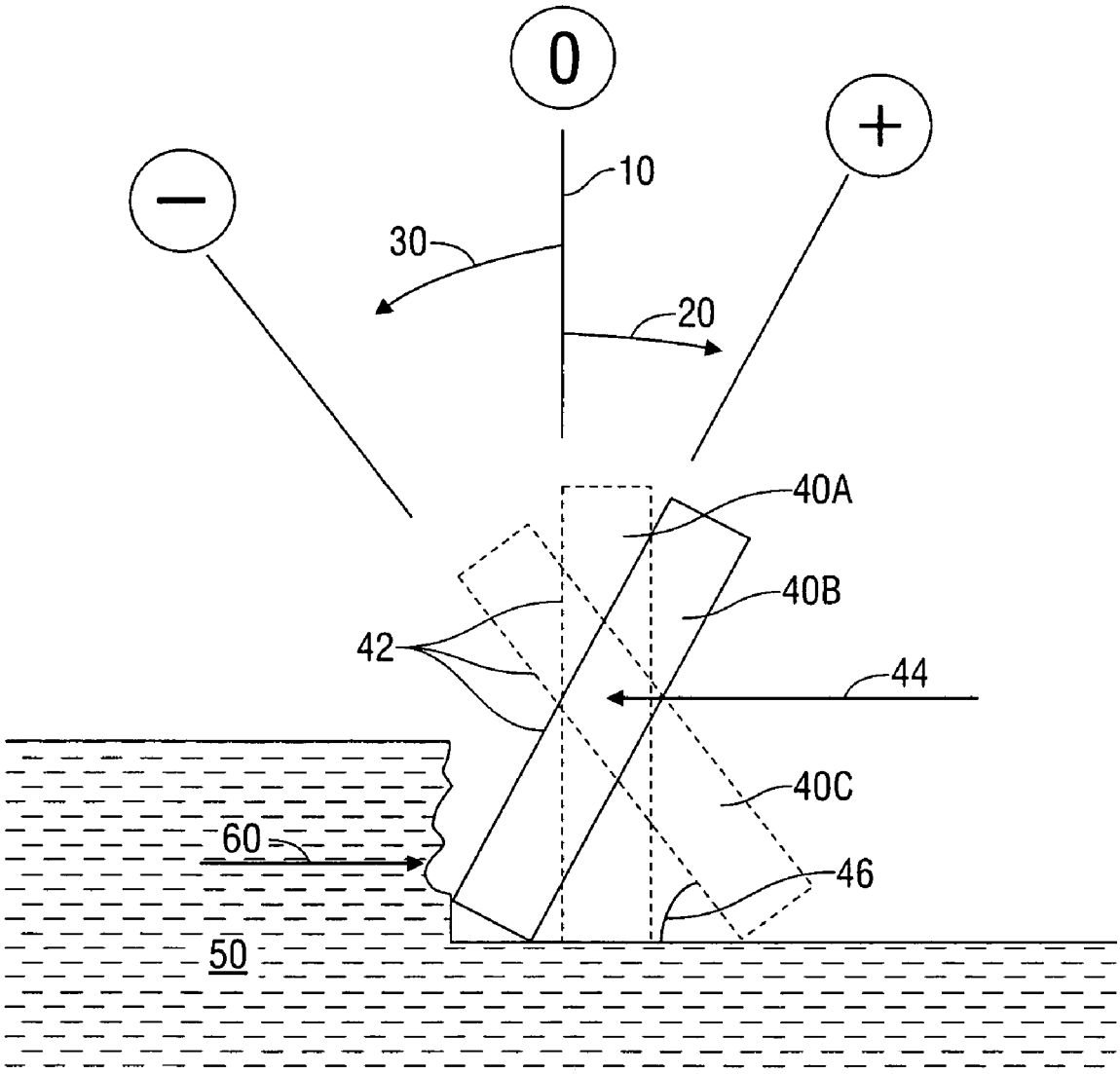
FIG. 2 PRIOR ART
FIG. 2 is a cross-sectional side view of a cutter of a drill bit as known in the art illustrating various rake angles in which the aggressiveness of a cutter, including a PDC-type cutter, may be altered with respect to how it is positioned to engage a formation.

FIG. 2 is a cross-sectional side view of a cutter of a drill bit as known in the art illustrating optional rake angles in which the aggressiveness of a PDC-type cutter may be altered with respect to how it is positioned to engage a formation. As shown in FIG. 2, the back rake angle of a gage cutter 40 may comprise a zero rake angle 10, a positive rake angle 20 or a negative rake angle 30. In the present invention, gage pad, or side cutters 40A, 40B, 40C are preferably positioned at an angle of between about zero rake 10 and a negative rake 30. For some applications, a negative rake of 30 degrees is effective in a variety of formations 50. As shown in FIG. 2, the cutting surface 42 of the cutter 40A, 40B, 40C having a negative rake angle 30 and moving in the direction noted by arrow 44 is impacted by forces indicated by the arrow 60 at an angle of incidence 46 which is equal to 90 degrees plus the amount of cutter rake. In this particular example, the actual angle of incidence 46 is about 53 degrees. The aggressiveness of the cutter 40 is at least partially a function of the angle of incidence 46, being generally regarded as at a maximum when rake angle 10 is zero degrees and regarded as at a minimum when a negative rake angle 30 of minus 90 degrees, presuming a positive rake angle 88 is not employed.

It is common in the art to design bits with many different types of cutter layouts or distribution patterns. What is common to each of these patterns is that there are between one and four central cutters whose spatial disposition is severely inefficient. This severe lack of sufficiency is due to the fact that in the central part of the bit, a 0.5" diameter cutter can only be optimized with respect to attack angle for a small portion of its diameter. There will be parts of the cutter with a correct approach or attack angle, and there will be parts of the cutter with acceptable attack angle and there will be parts of the cutter with inherently poor attack angle. This phenomenon disappears an inch or two outside of the central portion of the bit.

As discussed, traditionally, PDC bits have been used in very soft to medium hard rock. As PDC cutter technology has progressed, this application envelope has broadened to include hard and abrasive formations. Unfortunately, these same hard formations make the poor attack angles in the central part of the bit even more pronounced inhibiting the effectiveness of the bit.

In soft or even hard rock, this rarely occurs, as the rock is either too soft or excessively brittle to cause this type of effect. It either breaks off as it becomes too tall to support itself, or is broken or worn off simply by the body material rubbing against it. However, in some hard, abrasive formations with high rock strength levels, this central uncut portion can cause the bit to slow down due to the inherent inefficiency of the uncut portion of the hole.

Figure 3:
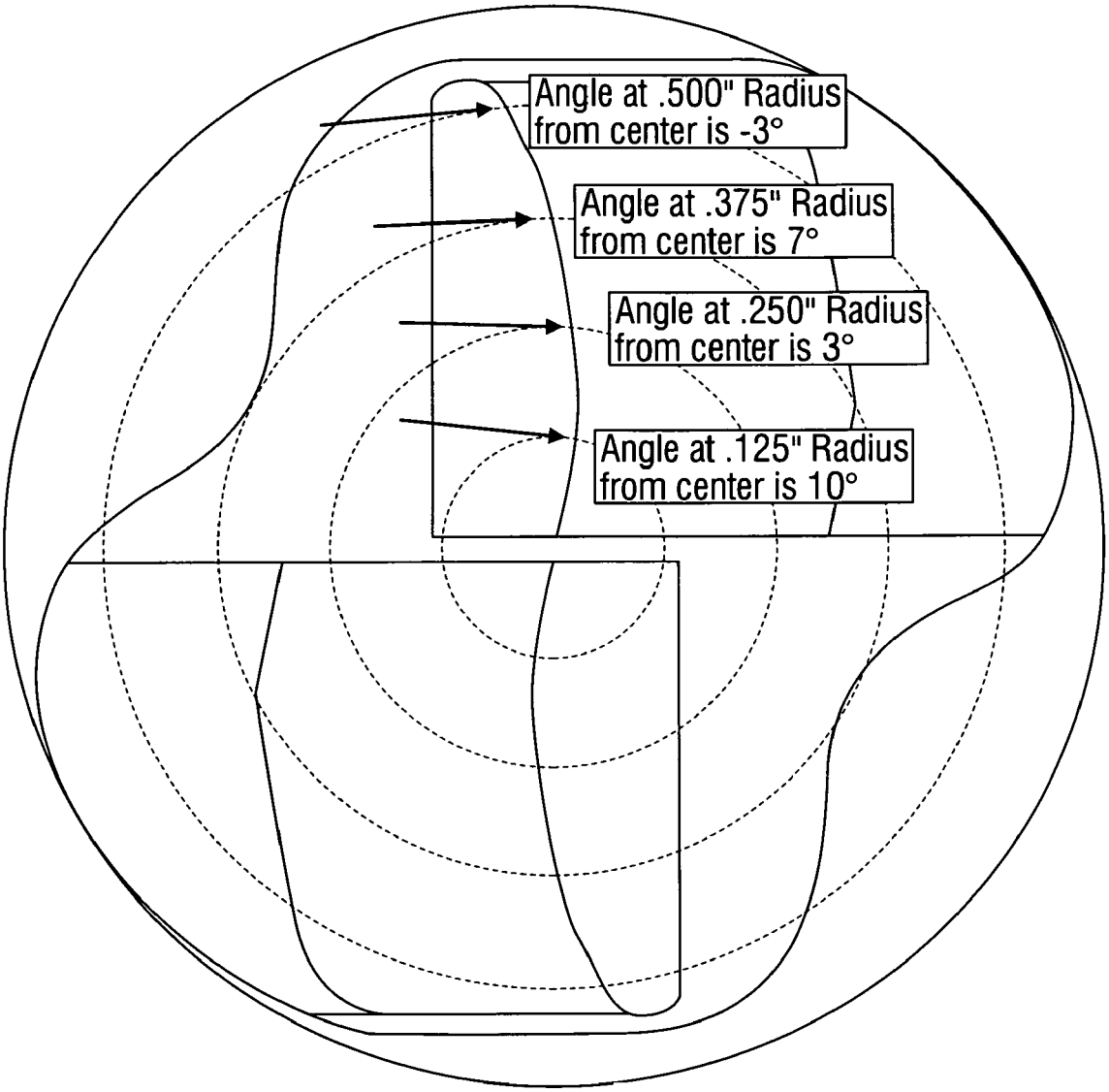
FIG. 3 is an illustration of a plan view of a two-cutter central drill bit structure according to the present invention illustrating an angle of attack that is very efficient for removing formation with respect to the central cutters in the direction of rotation.

FIG. 3 is an illustration of a two-cutter central PDC drill bit structure according to the present invention illustrating that the angle of attack is very efficient for removing formation with respect to the central cutters in the direction of rotation noted by the arrows. FIG. 3 is an illustration of a two-cutter central drill bit structure according to the present invention optimized for correct attack angle. As can be seen in FIG. 3, this central cutter places the various attack angles much closer to the optimum relative to the formation. The central portion of the cutting appliance itself is composed of two adjacent but opposed diamond tables leaving an absolute minimum of the formation uncut. The illustration shows four data points: (1) a −3.0° angle at a 0.5 inch radius from the center, (2) a 0.7° angle at a 0.375 inch radius from the center, (3) a 3.0° angle at a 0.250 inch radius from the center, and (4) a 10° angle at a 0.125 inch radius from the center. The small uncut portion will be dislodged by the PDC elements during rotation. The two-cutter central PDC drill bit structure is more effective than previous standard center cutters.

Figure 4:
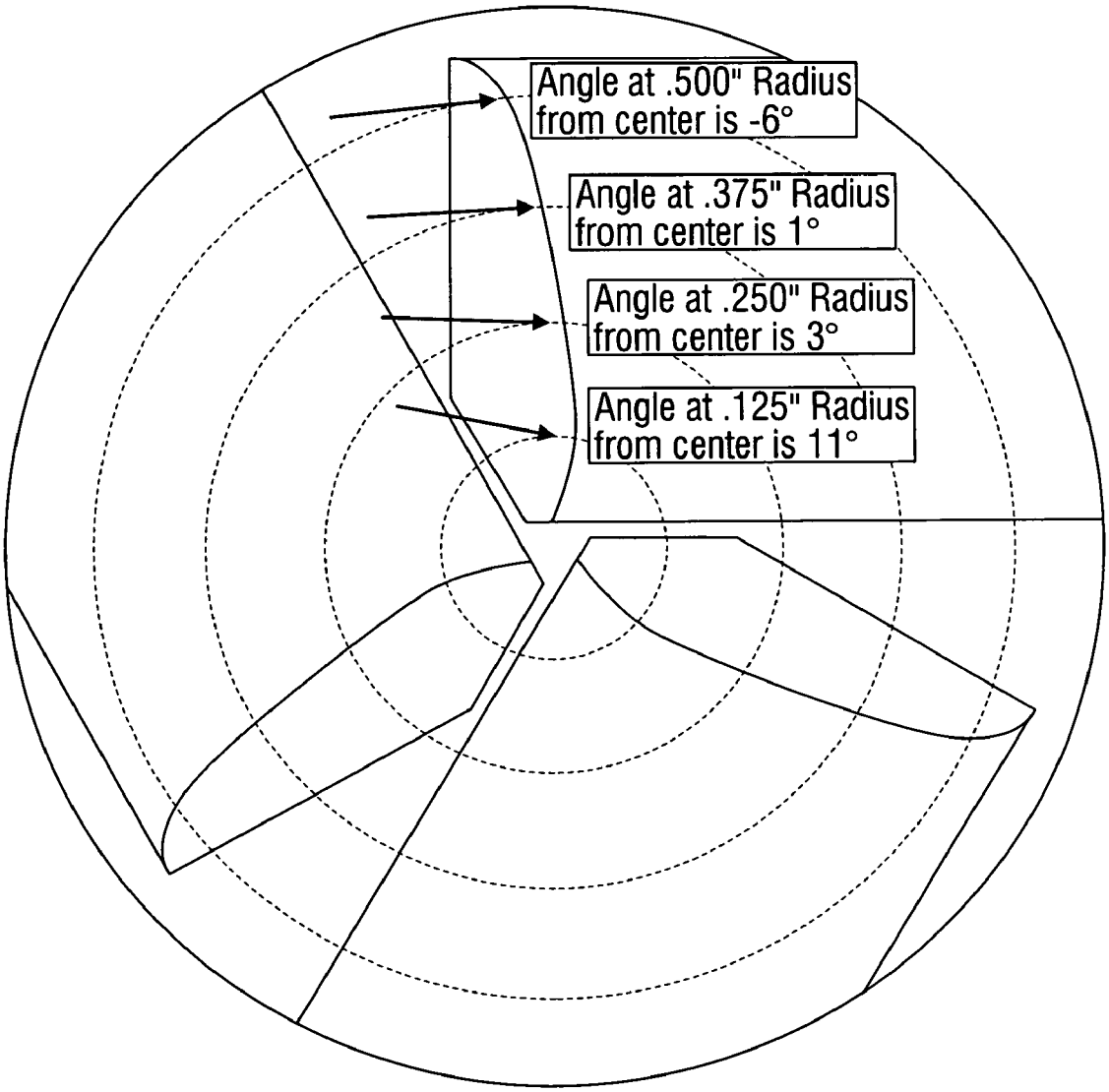
FIG. 4 is an illustration of a plan view of a three-cutter central drill bit structure according to the present invention illustrating an angle of attack that is very efficient for removing formation with respect to the central cutters in the direction of rotation.

FIG. 4 is an illustration of a three-cutter central drill bit structure according to the present invention illustrating that the angle of attack is very efficient for removing formation with respect to the central cutters in the direction of rotation. The three-cutter central drill bit structure illustrated in FIG. 4 is designed for a bit with three blades merging toward the center of the bit. The illustration shows four data points: (1) a −6.0° angle at a 0.5 inch radius from the center, (2) a 1° angle at a 0.375 inch radius from the center, (3) a 3.0° angle at a 0.250 inch radius from the center, and (4) a 11° angle at a 0.125 inch radius from the center. Again, the attack angles are much closer to the optimum relative to the formation, and more normalized with respect to the cutter rotation. There is an area of uncut rock, but the area is small enough that lateral movements of the bit from BHA vibrations will remove the rock from the central area.

Figure 5:
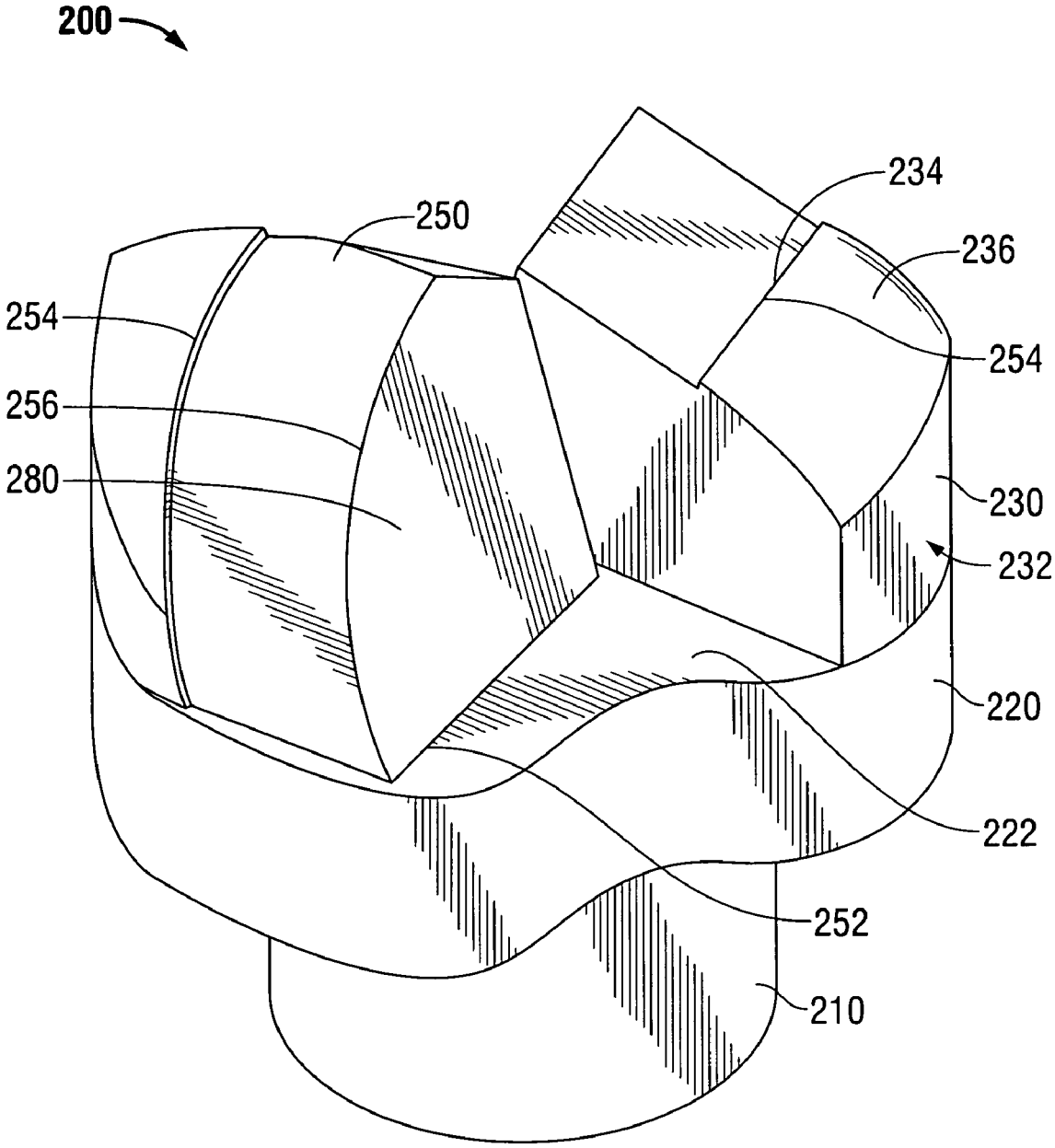
FIG. 5 is a perspective view of a two-cutter central drill bit structure according to the present invention, similar to the drill bit structure illustrated in FIG. 3, illustrating one embodiment of the central drill bit structure of the present invention.

FIG. 5 is a perspective view of a two-cutter central drill bit structure 200 according to the present invention, similar to the drill bit structure illustrated in FIG. 3, illustrating one embodiment of the central drill bit structure of the present invention. FIG. 5 illustrates one embodiment of the central drill bit structure 200 of the present invention. The two-cutter central drill bit structure 200 comprises an end portion 210, a central member 220 and the two cutters supports 230. The cutter supports 230 in conjunction with the joining surface 222 support the cutting elements 250. The cutting elements 250 have an exterior surface 256 that has on it the diamond-cutting surface 280. Also, the cutting elements 250 have a base surface 252 that engages the joining surface 222 associated with the central member 220 of the structure 200. The two side surfaces 232 are slightly overlapped with respect to the cutting element 250. The support 230 has a sloping surface 236 with an engaging surface 234 that supports and secures the engaging surface 254 of the cutting element 250.

Figure 6:
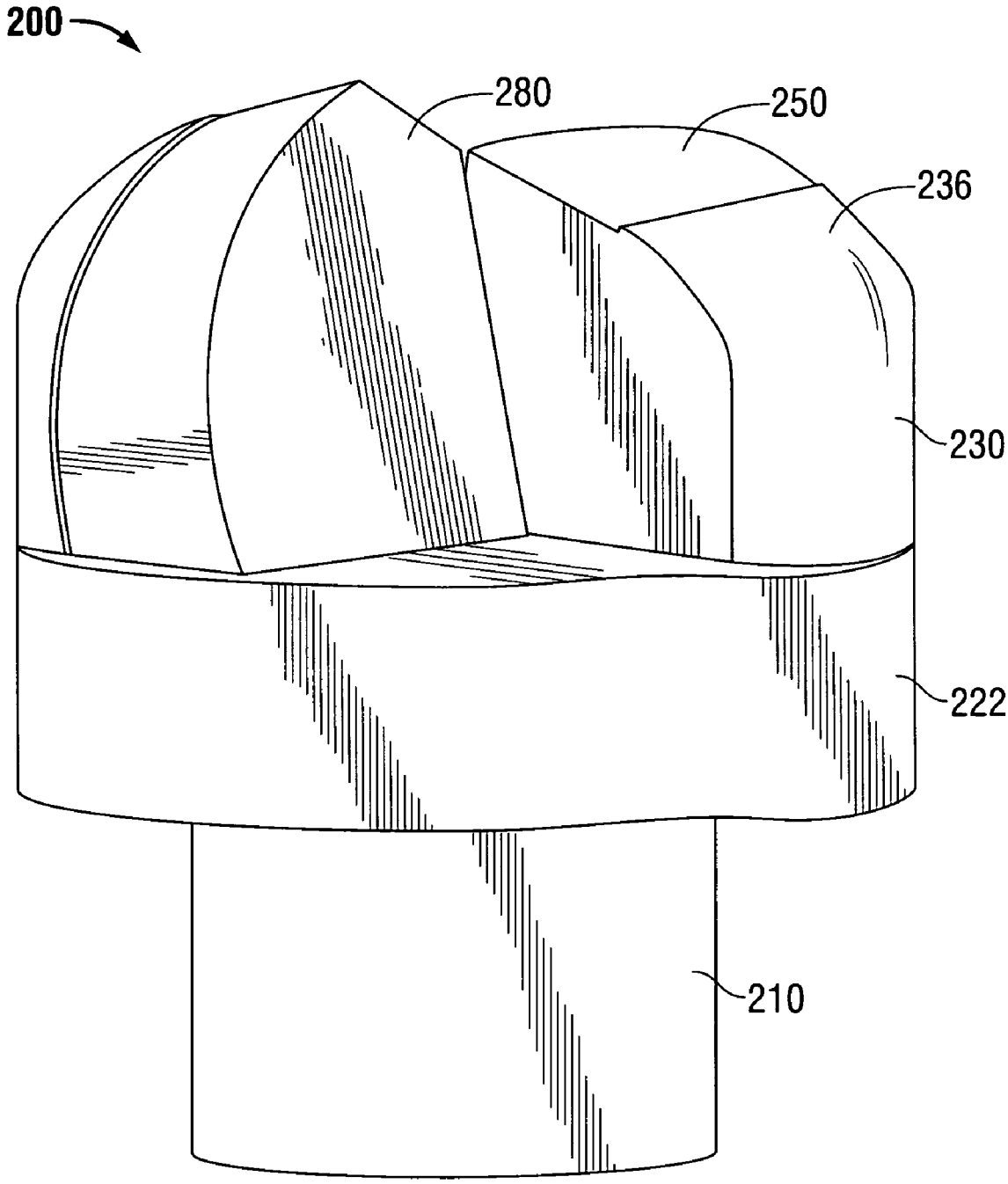
FIG. 6 is an elevation view of the two-cutter central drill bit structure according to the present invention as illustrated in FIG. 5, similar to the drill bit structure illustrated in FIG. 3, illustrating one embodiment of the central drill bit structure of the present invention.

FIG. 6 is a top view of the two-cutter central drill bit structure 200 according to the present invention as illustrated in FIG. 5 and similar to the drill bit structure illustrated in FIG. 3, illustrating one embodiment of the central drill bit structure 200 of the present invention. The two-cutter central drill bit structure 200 comprises a central member 220 having a joining surface 222, a cutter support 230 and a cutting element 250. One of the two cutting elements 250 is illustrated with the diamond-cutting surface 280 exposed.

Figure 7:
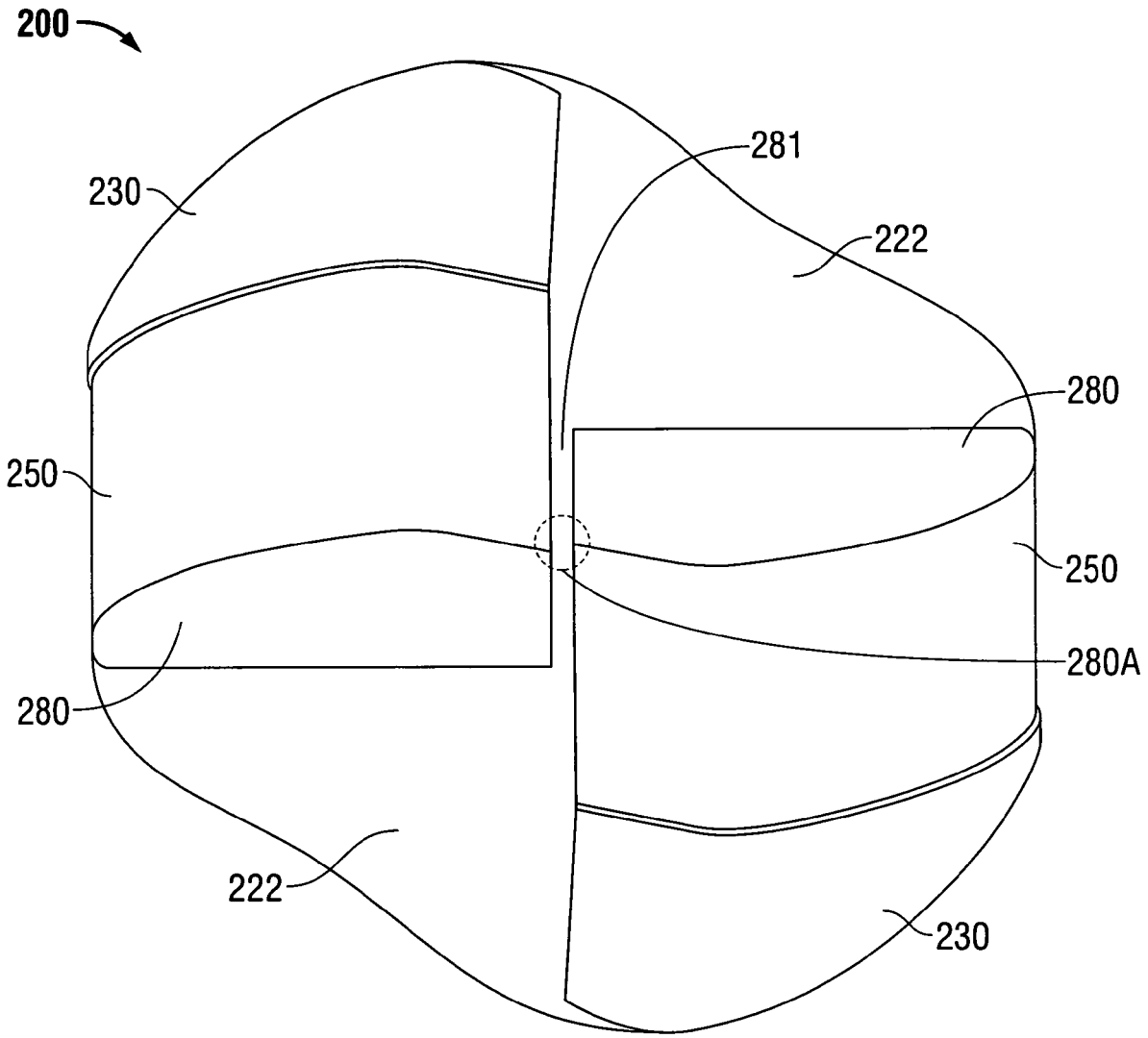
FIG. 7 is a plan view of the two-cutter central drill bit structure according to the present invention, similar to the drill bit structure illustrated in FIGS. 3, 5 and 6, illustrating one embodiment of the central drill bit structure of the present invention.

FIG. 7 is a plan view of the two-cutter central drill bit structure 200 according to the present invention, similar to the drill bit structure illustrated in FIGS. 3, 5 and 6, illustrating one embodiment of the central drill bit structure 200 of the present invention. The two-cutter central drill bit structure 200 is illustrated with a joining surface 222, a cutter support 230 and a cutting element 250. Both of the two cutting elements 250 are illustrated with the diamond-cutting surfaces 280 exposed. A gap 281 is created be the two cutting elements 250. The gap 281 provides an angled relationship between the cutting elements 250 such that there is a match at the top portion or apex 280A of the cutting elements 250. The angled relationship provides for increasing overlap from the apex 280A of the cutting elements 250 to the joining surface 222.

Figure 7A:
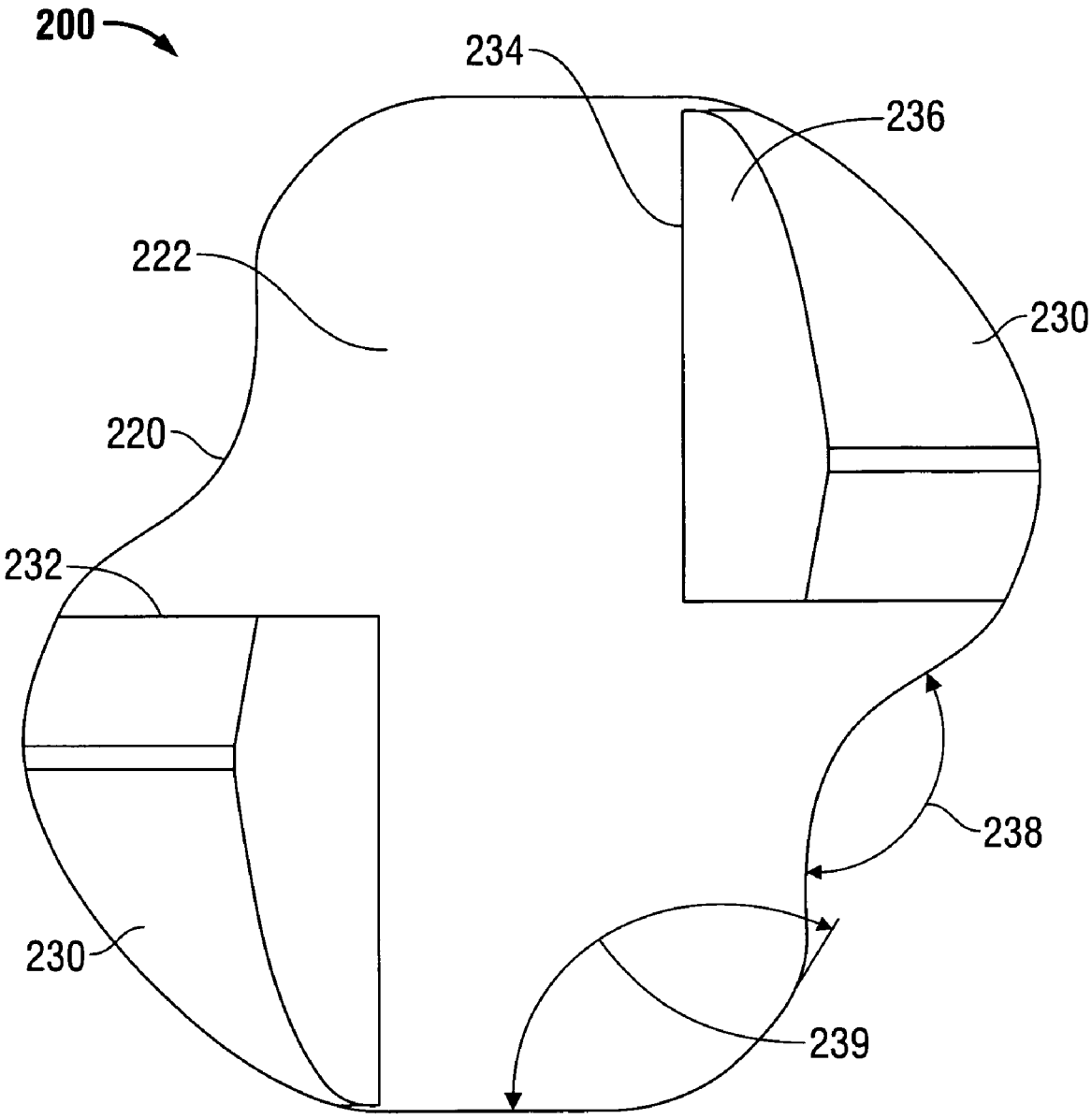
FIG. 7A is a plan view of the two-cutter central drill bit structure according to the present invention without the PDC cutters, similar to the drill bit structure illustrated in FIGS. 3, 5, 6 and 7, illustrating one embodiment of the central drill bit structure of the present invention.

FIG. 7A is a plan view of the two-cutter central drill bit structure 200 according to the present invention without the PDC cutters, similar to the drill bit structure illustrated in FIGS. 3, 5, 6 and 7, illustrating one embodiment of the central drill bit structure of the present invention. Particularly, the alternate sided, concaved arcuate angles 238 are illustrated. The alternate sided, concaved arcuate angles 238 have an arc of approximately 120°. Similarly, the alternate sided, convexed arcuate angles 239 are illustrated. The alternate sided, convexed arcuate angles 239 also have an arc of approximately 120°.

Figure 8:
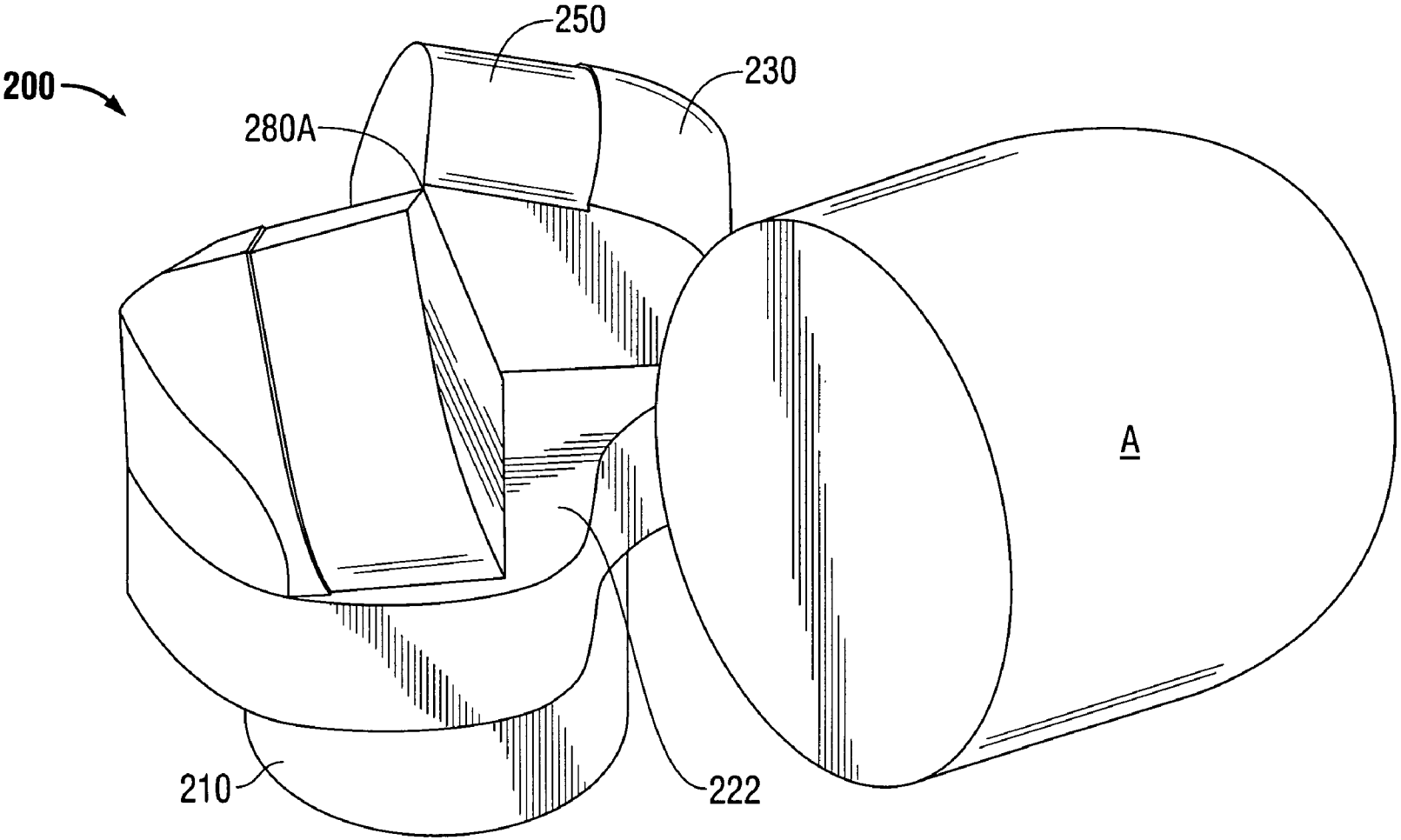
FIG. 8 is a perspective view of a two-cutter central drill bit structure according to the present invention, similar to the drill bit structure illustrated in FIGS. 3, 5, 6 and 7, illustrating one embodiment of the central drill bit structure of the present invention in association with an adjacent cutter element.

FIG. 8 is a perspective view of a two-cutter central drill bit structure 200 according to the present invention, similar to the drill bit structure illustrated in FIGS. 3, 5, 6 and 7, illustrating one embodiment of the central drill bit structure of the present invention in association with an adjacent cutter element. The two-cutter central drill bit structure 200 is illustrated with a joining surface 222, a cutter support 230 and a cutting element 250. Both of the two cutting elements 250 are illustrated with the diamond-cutting surfaces 280 exposed. The angled relationship of the cutting elements 250 provides for increasing overlap from the apex 280A of the cutting elements 250 to the joining surface 222.

Figure 9:
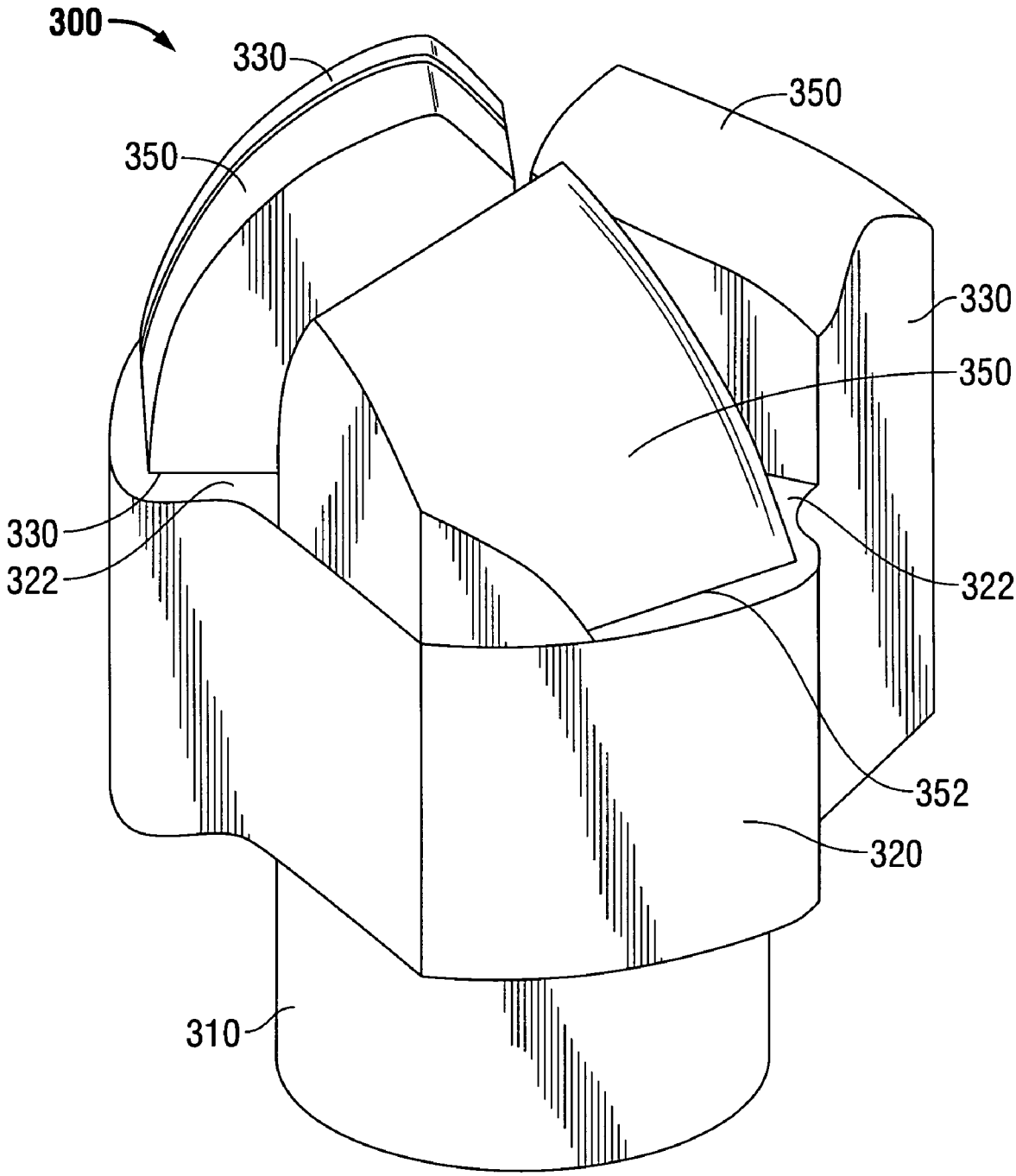
FIG. 9 is a perspective view of a three-cutter central drill bit structure according to the present invention, similar to the drill bit structure illustrated in FIG. 4, illustrating one embodiment of the central drill bit structure of the present invention.

FIG. 9 is a perspective view of a three-cutter central drill bit structure 300 according to the present invention, similar to the drill bit structure illustrated in FIG. 4, illustrating one embodiment of the central drill bit structure 300 of the present invention. FIG. 9 illustrates one embodiment of the central drill bit structure 300 of the present invention. The three-cutter central drill bit structure 300 comprises an end portion 310, a central member 320 and the three cutters supports 330. The cutter supports 330 in conjunction with the joining surface 322 support the cutting elements 350. The cutting elements 350 have an exterior surface having a diamond-cutting surface 380 disposed thereon. Also, the cutting elements 350 have a base surface 352 that engages the joining surface 322 associated with the central member 320 of the structure 300. The three side surfaces 332 are slightly overlapped with respect to the cutting element 350. The support 330 has a structure similar to that of the cutters shown in FIGS. 5-7, which include a sloping surface with an engaging surface that supports and secures the cutting element 350. The depicted slope and configuration of the cutting elements 350 provides the diamond-cutting surface 380 of each cutting element with a side-rake angle of approximately zero degrees. Other embodiments can include a side-rake angle ranging from −15 degrees to 15 degrees.

Figure 10:
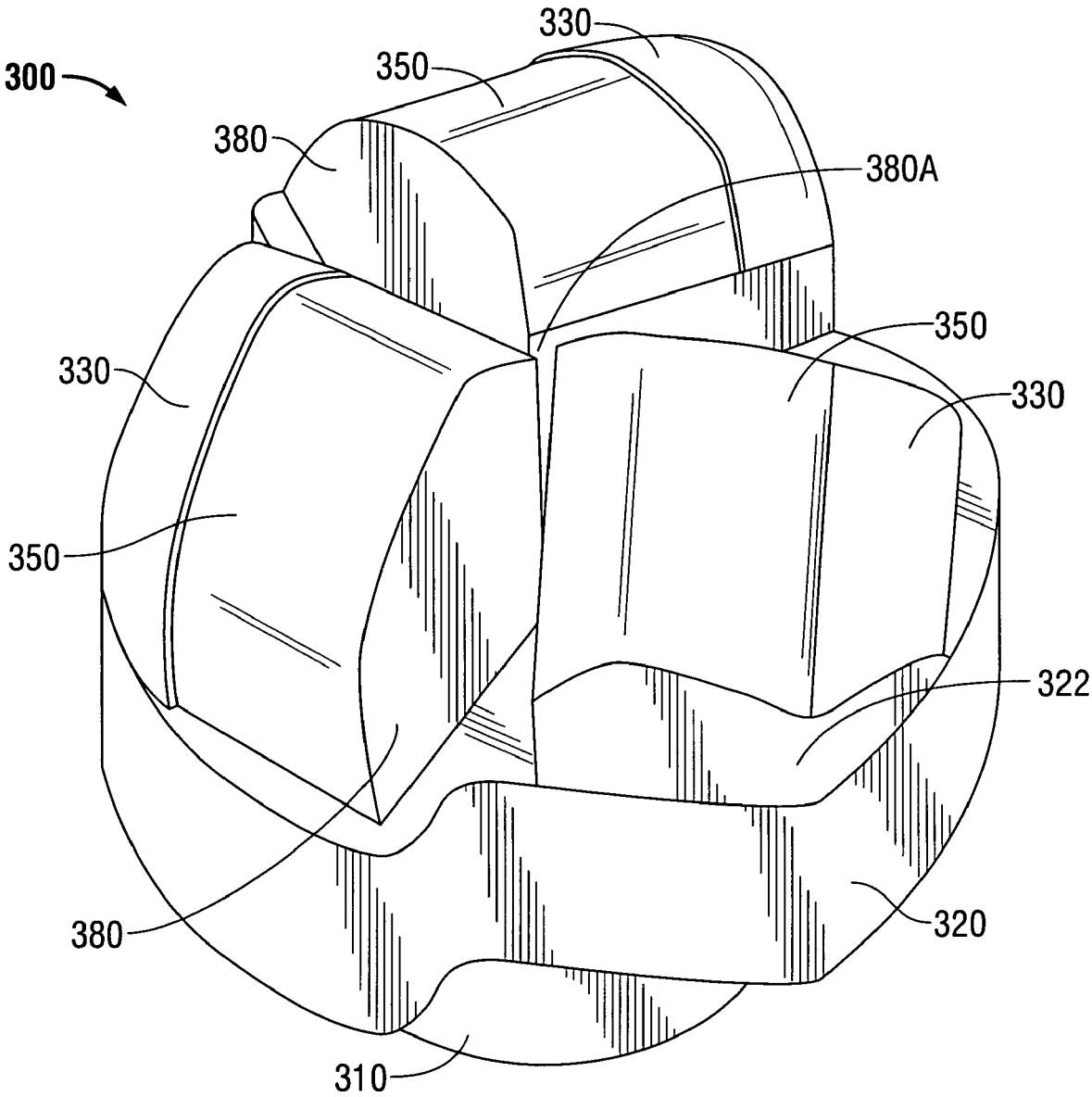
FIG. 10 is another perspective view of a three-cutter central drill bit structure according to the present invention, similar to the drill bit structure illustrated in FIGS. 4 and 9, illustrating one embodiment of the central drill bit structure of the present invention.

FIG. 10 is another perspective view of a three-cutter central drill bit structure 300 according to the present invention, similar to the drill bit structure illustrated in FIGS. 4 and 9, illustrating one embodiment of the central drill bit structure 300 of the present invention. The cutter supports 330 in conjunction with the joining surface 322 support the cutting elements 350. The cutting elements 350, as described previously, have an exterior surface on which the diamond-cutting surface 380 is disposed. Also, the cutting elements 350 have a base surface 352 that engages the joining surface 322 associated with the central member 320 of the structure 300. The side surfaces of the cutting elements 350 are slightly overlapped with respect to each other cutting element. The support 330, as described previously has a sloping surface with an engaging surface that supports and secures cutting element 350.

Figure 11:
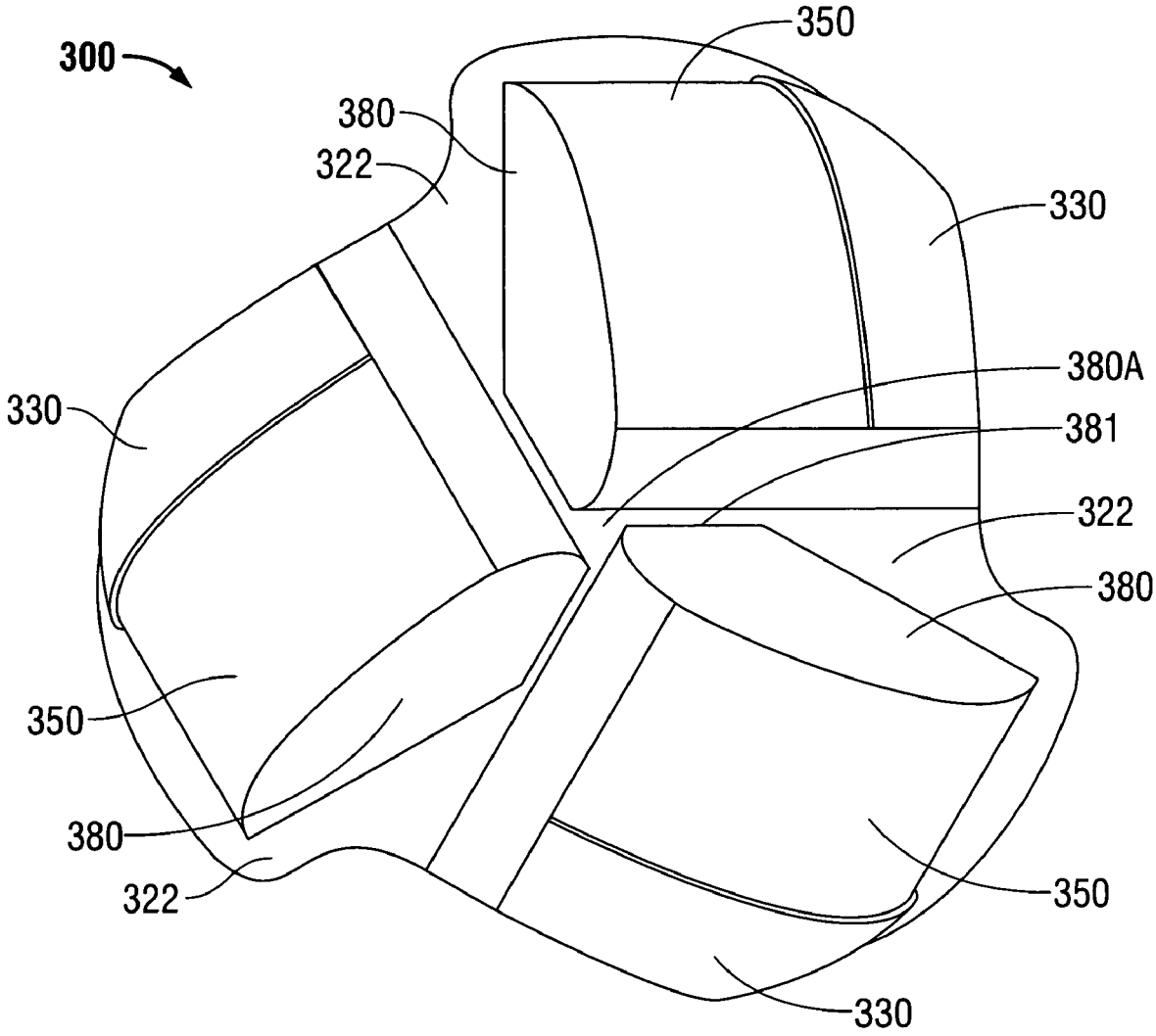
FIG. 11 is an top or plan view of the three-cutter central drill bit structure according to the present invention as illustrated in FIGS. 4, 9 and 10, illustrating one embodiment of the central drill bit structure of the present invention.

FIG. 11 is an top or plan view of the three-cutter central drill bit structure 300 according to the present invention as illustrated in FIGS. 4, 9 and 10, illustrating one embodiment of the central drill bit structure 300 of the present invention.

The three-cutter central drill bit structure 300 is illustrated with a joining surface 322, a cutter support 330 and a cutting element 350. All of the three cutting elements 350 are illustrated with the diamond-cutting surfaces 380 exposed. A gap 381 is created between the two cutting elements 350. The gap 381 provides an angled relationship between the cutting elements 350 such that there is a match at the top portion or apex 380A of the cutting elements 350. The angled relationship provides for increasing overlap from the apex 380A of the cutting elements 350 to the joining surface 322.

Figure 12:
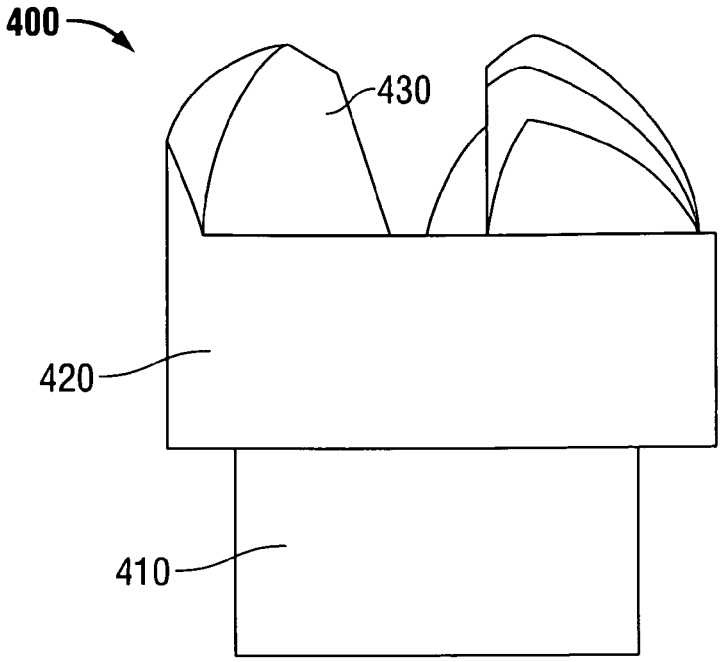
FIG. 12 is an elevation view of a three-cutter central drill bit structure according to the present invention without the cutting elements, but similar to the drill bit structure illustrated in FIGS. 4, 9, 10 and 11, illustrating another embodiment of the central drill bit structure of the present invention.

FIG. 12 is an elevation view of a three-cutter central drill bit structure 400 according to the present invention without the cutting elements, but similar to the drill bit structure illustrated in FIGS. 4, 9, 10 and 11, illustrating another embodiment of the central drill bit structure 400 of the present invention. The three-cutter central drill bit structure 400 comprises an end portion 410, a central member 420 and a cutter support 430.

Figure 13:
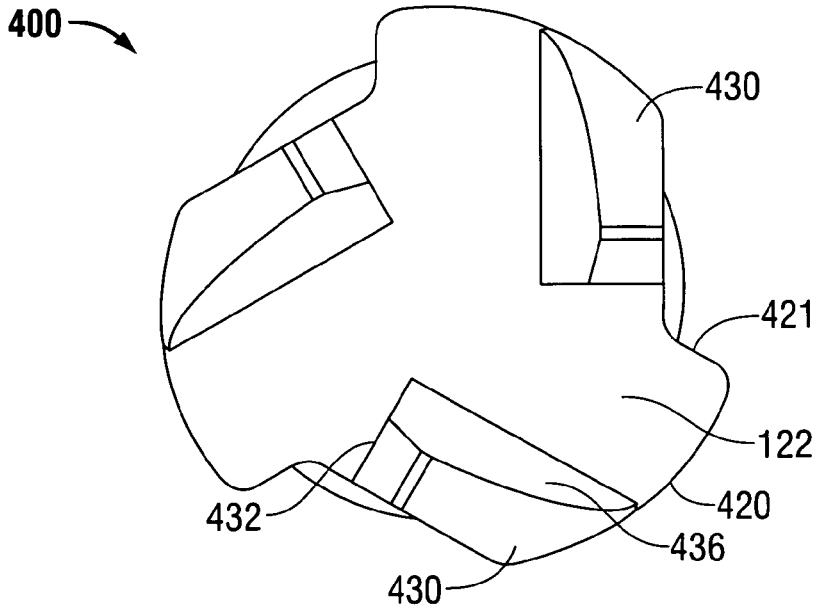
FIG. 13 is a top or plan view of a three-cutter central drill bit structure according to the present invention without the cutting elements, but similar to the drill bit structure illustrated in FIGS. 4, 9, 10, 11 and 12, illustrating another embodiment of the central drill bit structure of the present invention.

FIG. 13 is a top or plan view of a three-cutter central drill bit structure 400 according to the present invention without the cutting elements, but similar to the drill bit structure illustrated in FIGS. 4, 9, 10, 11 and 12, illustrating another embodiment of the central drill bit structure 400 of the present invention. The three-cutter central drill bit structure 400 comprises a joining surface 122 supporting a cutter support 430. The cutter support 430 has at least two sides 436, 432. Symmetrical with the three-cutter central drill bit structure 400 are three concaved arcs 421. The concaved arcs 421 are provided in the perimeter of the central member 420 and joining surface 122. In the present embodiment, the concaved arcs 421 are approximately one hundred twenty degrees. It can be appreciated by those skilled in the art that modifications to the present invention will remain within the scope and content of the present invention.

Figure 14:
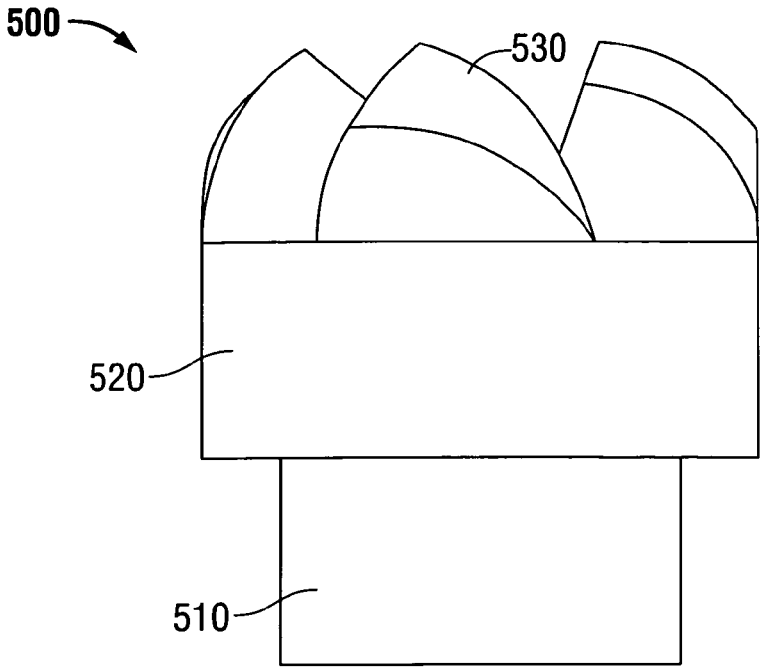
FIG. 14 is an elevation view of another embodiment of a three-cutter central drill bit structure according to the present invention without the cutting elements illustrating the another embodiment of the central drill bit structure of the present invention.

FIG. 14 is an elevation view of another embodiment of a three-cutter central drill bit structure 500 according to the present invention without the cutting elements illustrating the another embodiment of the central drill bit structure 500 of the present invention. The three-cutter central drill bit structure 500 comprises an end portion 510, a central member 520 and a cutter support 530.

Figure 15:
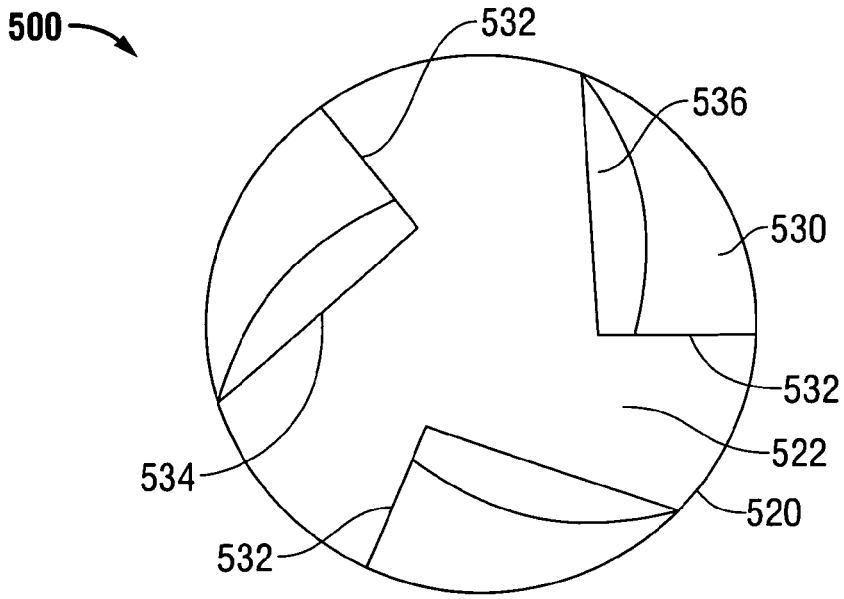
FIG. 15 is a top or plan view of the embodiment of a three-cutter central drill bit structure illustrated in FIG. 14 without the cutting elements illustrating the another embodiment of the central drill bit structure of the present invention.

FIG. 15 is a top or plan view of the embodiment of a three-cutter central drill bit structure illustrated in FIG. 14 without the cutting elements illustrating the another embodiment of the central drill bit structure of the present invention. The three-cutter central drill bit structure 500 is illustrated with a joining surface 522 and a cutter support 530. The cutter support 530 has sides 532, 534, 536.

Figure 16:
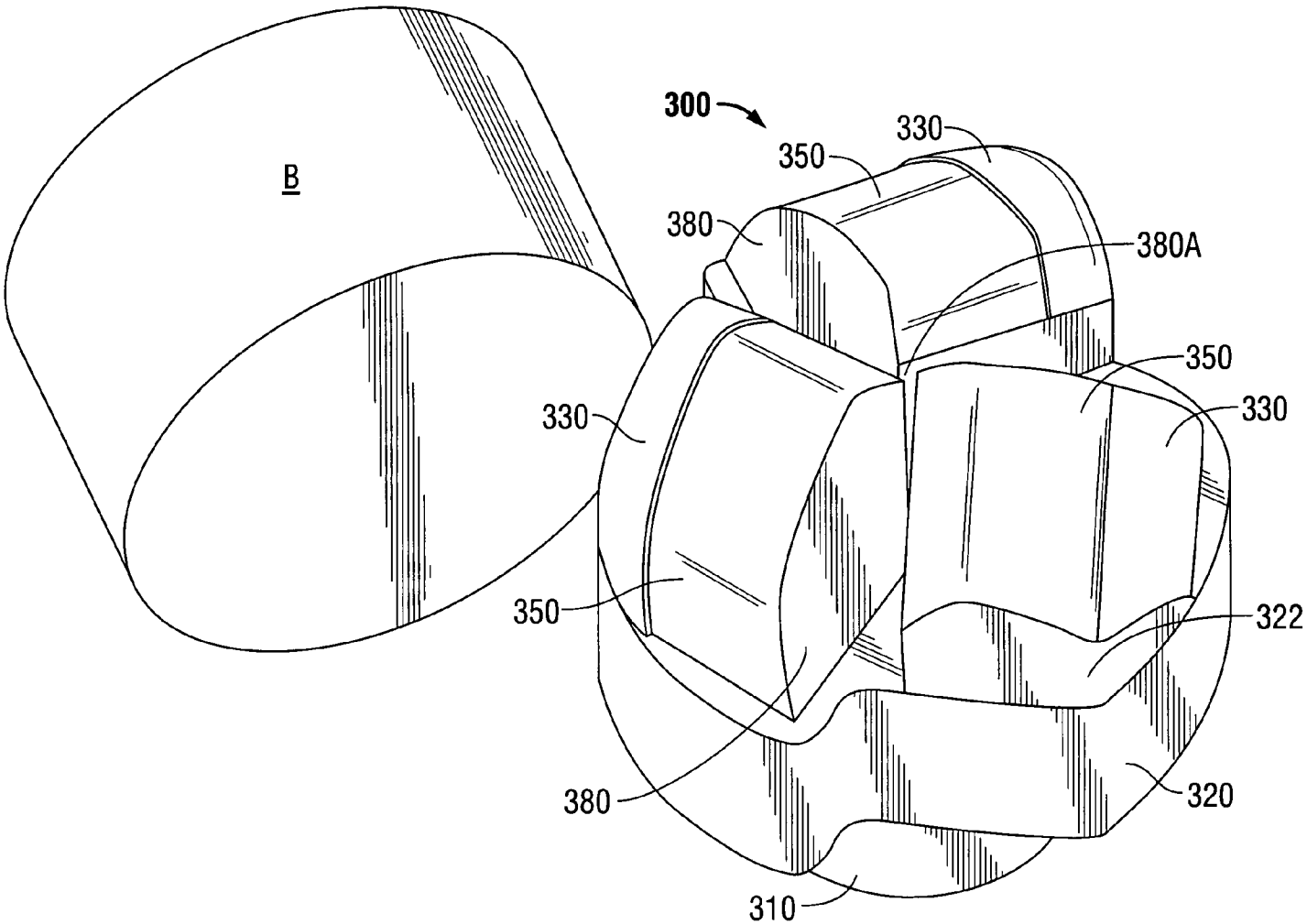
FIG. 16 is a perspective view of a three-cutter central drill bit structure according to the present invention, similar to the drill bit structure illustrated in FIGS. 9, 10, 11, 12 and 13, illustrating one embodiment of the central drill bit structure of the present invention in association with an adjacent cutter element.

FIG. 16 is a perspective view of a three-cutter central drill bit structure 300 according to the present invention, similar to the drill bit structure illustrated in FIGS. 9, 10, 11, 12 and 13, illustrating one embodiment of the central drill bit structure 300 of the present invention in association with an adjacent cutter element. The three-cutter central drill bit structure 300 is illustrated with a joining surface 322, a cutter support 330 and a cutting element 350. All of the three cutting elements 350 are illustrated with the diamond-cutting surfaces 380 exposed. The angled relationship of the cutting elements 350 provides for increasing overlap from the apex 380A of the cutting elements 350 to the joining surface 322.

Figure 17:
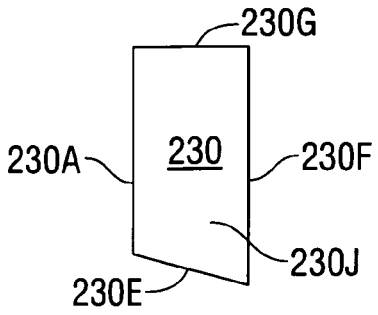
FIG. 17 is an elevation view of the cutter element used in the two-cutter central drill bit structure illustrated in FIGS. 3, 5, 6, 7 and 8 according to the present invention.

FIG. 17 is an elevation view of the cutter 230 used in the two-cutter central drill bit structure 200 illustrated in FIGS. 11, 12 and 13 according to the present invention. The cutter 230 comprises the sides 230A, 230B, 230C, 230D, 230E.

Figure 18:
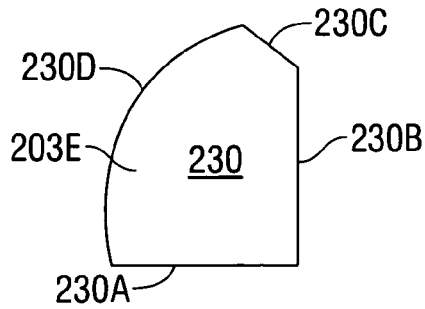
FIG. 18 is an elevation view of the cutter element illustrated in FIG. 17 rotated to illustrate an alternate side and as used in the two-cutter central drill bit structure illustrated in FIGS. 3, 5, 6, 7 and 8 according to the present invention.

FIG. 18 is another elevation view of the cutter 230 used in the two-cutter central drill bit structure 200 illustrated in FIGS. 11, 12 and 13 according to the present invention. The cutter 230 comprises the sides 230F, 230G, 230H, 230I, 230J.

Figure 19:
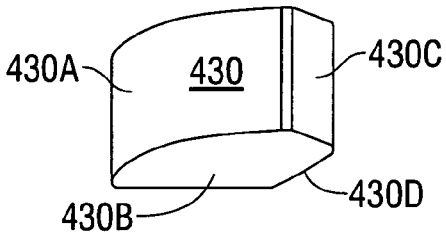
FIG. 19 is a perspective view of the cutter element used in the three-cutter central drill bit structure illustrated in FIGS. 9, 10, 11, 12 and 13 according to the present invention.

FIG. 19 is plan view of the alternate preferred embodiment of the three-cutter central drill bit structure 400 illustrated in FIG. 18 illustrating the cutters 430 according to the present invention.

Figure 20:
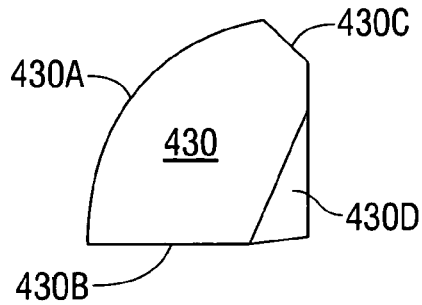
FIG. 20 is a side view of the cutter element illustrated in FIG. 19 rotated to illustrate an alternate side and as used in the three-cutter central drill bit structure illustrated in FIGS. 9, 10, 11, 12 and 13 according to the present invention.

FIG. 20 is an expanded, plan view of the alternate preferred embodiment of the three-cutter central drill bit structure 400 illustrated in FIG. 18 illustrating the cutters 430 according to the present invention.

Figure 21:
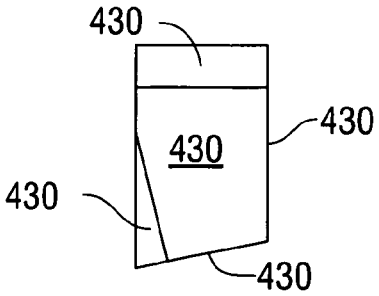
FIG. 21 is another side view of the cutter element illustrated in FIGS. 19 and 21 rotated to illustrate an alternate side and as used in the three-cutter central drill bit structure illustrated in FIGS. 9, 10, 11, 12 and 13 according to the present invention.

FIG. 21 is a perspective view of the cutter 430 used in the three-cutter central drill bit structure 400 illustrated in FIGS. 18, 19 and 20 according to the present invention. The cutter 430 comprises the sides 430A, 430B, 430C, 430D, 430E.

Figure 22:
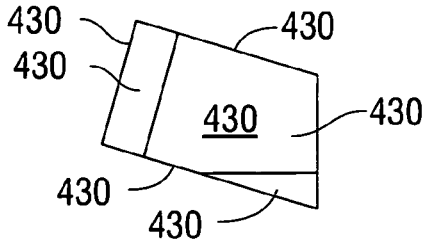
FIG. 22 is another side view of the cutter element illustrated in FIGS. 19, 20 and 21 rotated to illustrate an alternate side and as used in the three-cutter central drill bit structure illustrated in FIGS. 9, 10, 11, 12 and 13 according to the present invention.

FIG. 22 is a side view of the cutter 430 illustrated in FIG. 21 rotated to illustrate an alternate side and as used in the three-cutter central drill bit structure 400 illustrated in FIGS. 18, 19 and 20 according to the present invention. The cutter 430 comprises the sides 430A, 430B, 430C, 430D, 430E.

Figure 23:
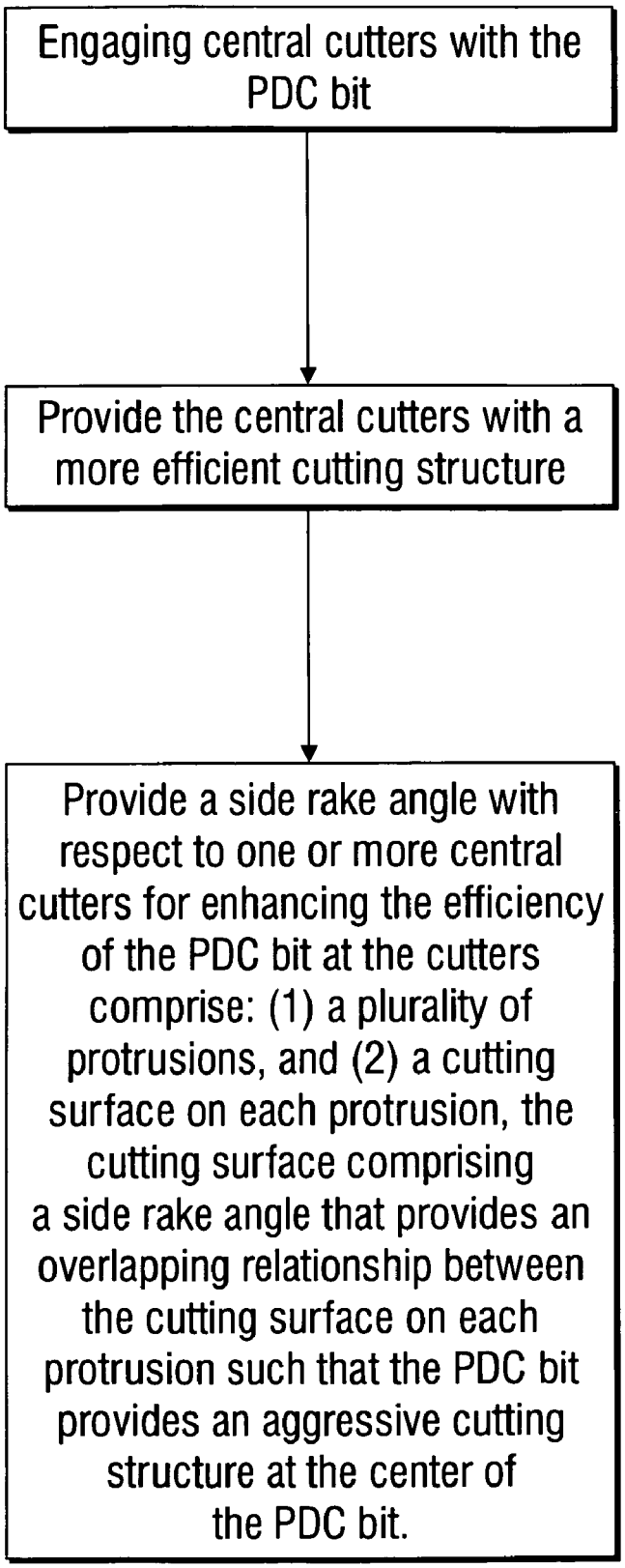
FIG. 23 flow chart of the method of the present invention.

FIG. 23 flow chart of the method of the present invention.

All of the embodiments as well as those appreciated by one skilled in the art after appreciating this disclosure allow for placing cutters immediately adjacent to and overlapping the central fixture. Typically, the central fixture itself is composed of sintered tungsten carbide with PDC cutters in specific shapes LS bonded to the surface.

It is possible that the disclosed type of fixtures could be built from steel or matrix, but it is preferred to use sintered tungsten carbide for increased wear resistance and manufacturing accuracy. It is also possible that these embodiments could be cast within the bit mold itself, and then the specialized cutter shapes brazed in. Further, central cutting appliances supporting even more blades to center, e.g., four or even five, is readily appreciated by those skilled in the art.

Further to the above detailed increase in drilling efficiency, these central fixtures allow a single brazing operation in the center of the bit, replacing 2 or 3 separate cutters with a single, pre-manufactured, higher efficiency cutting unit.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A PDC drill bit for subterranean drilling or forming boreholes in subterranean formations comprising:

(a) a drill bit body;

(b) a central cutting member for enhancing the efficiency of the PDC bit at the center of the drill bit body, the central cutting member comprising:

(1) an end portion for engaging the drill bit body;

(2) a member adjacent the end portion, wherein the member comprises a center and an edge; and (3) a plurality of cutters supported by the member, the plurality of cutters each comprising:

a cutting surface comprising a base surface disposed against the member and extending radially between the center and the edge, and an inner surface extending upward from the center and terminating proximate to the inner surface of each other cutter at an apex, wherein the cutting surface comprises a side rake angle that provides an overlapping relationship between each cutting surface such that the PDC bit provides an aggressive cutting structure at the center of the PDC bit.

2. The PDC drill bit for subterranean drilling or forming boreholes in subterranean formations as defined in claim 1 wherein the plurality of cutters comprises two cutters.

3. The PDC drill bit for subterranean drilling or forming boreholes in subterranean formations as defined in claim 1 wherein the plurality of cutters comprises three cutters.

4. The PDC drill bit for subterranean drilling or forming boreholes in subterranean formations as defined in claim 1 wherein the end portion for engaging the drill bit body comprises a cylindrical portion.

5. The PDC drill bit for subterranean drilling or forming boreholes in subterranean formations as defined in claim 1 wherein the member adjacent the end portion fixedly engages the plurality of cutters and the end portion.

6. The PDC drill bit for subterranean drilling or forming boreholes in subterranean formations as defined in claim 5 wherein the member, the plurality of cutters and the end portion are a unitary structure.

7. The PDC drill bit for subterranean drilling or forming boreholes in subterranean formations as defined in claim 1 wherein the cutting surface on each protrusion comprises a side rake angle within the range of approximately −15 degrees to 15 degrees.

8. The PDC drill bit for subterranean drilling or forming boreholes in subterranean formations as defined in claim 1 wherein the central cutting member is comprised of sintered tungsten carbide.

9. The PDC drill bit for subterranean drilling or forming boreholes in subterranean formations as defined in claim 1 comprising at least three cutting surfaces.

10. The PDC drill bit for subterranean drilling or forming boreholes in subterranean formations as defined in claim 1 wherein the plurality of cutters are immediately adjacent to and overlapping the center of the PDC drill bit.

11. The PDC drill bit for subterranean drilling or forming boreholes in subterranean formations as defined in claim 1 wherein the cutting surface further comprises a curved outer surface which extends from the edge to the apex.

12. A method for enhancing the efficiency of a PDC bit at the center of the drill bit body, the PDC bit having cutters distributed thereupon, the method comprising the steps of:

(a) engaging central cutters with the PDC bit;

(b) providing the central cutters with a more efficient cutting structure, wherein the central cutters comprise:

a member having a center and an edge; and a cutting surface comprising a base surface disposed against the member and extending radially between the center and the edge, and an inner surface extending upward from the center and terminating proximate to the inner surface of each other cutter at an apex;

(c) providing a side rake angle with respect to one or more central cutters for enhancing the efficiency of the PDC bit at the center of the drill bit body such that the side rake angle provides an overlapping relationship between the cutting surface on each central cutter such that the PDC bit provides an aggressive cutting structure at the center of the PDC bit.

13. The method for enhancing the efficiency of a PDC bit at the center of the drill bit body as defined in claim 12 wherein the step of providing the central cutters with a more efficient cutting structure comprises displacing at least two cutters relative to one another and providing an angled relationship between said at least two cutters.

14. The method for enhancing the efficiency of a PDC bit at the center of the drill bit body as defined in claim 12 wherein the step of providing a side rake angle of approximately zero with respect to the central cutters comprises the step of providing a side rake angle within the range of approximately −15 degrees to 15 degrees.

15. The method for enhancing the efficiency of a PDC bit at the center of the drill bit body as defined in claim 12 wherein the step of providing the central cutters with a more efficient cutting structure further comprises the step of placing a plurality of cutters immediately adjacent to and overlapping the center of the PDC drill bit.

16. The method for enhancing the efficiency of a PDC bit at the center of the drill bit body as defined in claim 12 wherein the cutting surface further comprises a curved outer surface which extends from the edge to the apex.

17. An insert for a PDC drill bit for subterranean drilling or forming boreholes in subterranean formations comprising a plurality of cutters supported by an end portion, the plurality of cutters comprising a central cutting member for enhancing the efficiency of the PDC bit at the center of the drill bit body, the central cutting member comprising:

(a) an end portion for engaging the drill bit body;

(b) a member adjacent the end portion, wherein the member comprises a center and an edge; and (c) a plurality of cutters supported by the member, the plurality of cutters each comprising:

a cutting surface comprising a base surface disposed against the member and extending radially between the center and the edge, and an inner surface extending upward from the center and terminating proximate to the inner surface of each other cutter at an apex, wherein the cutting surface comprises a side rake angle that provides an overlapping relationship between each cutting surface such that the PDC bit provides an aggressive cutting structure at the center of the PDC bit.

18. The insert for a PDC drill bit for subterranean drilling or forming boreholes in subterranean formations as defined in claim 17 wherein the plurality of cutters and the end portion are a unitary structure.

19. The insert for a PDC drill bit for subterranean drilling or forming boreholes in subterranean formations as defined in claim 17 wherein the cutting surface on each protrusion comprises a side rake angle within the range of approximately −15 degrees to 15 degrees.

20. The insert for a PDC drill bit for subterranean drilling or forming boreholes in subterranean formations as defined in claim 17 wherein the insert is comprised of sintered tungsten carbide.

21. The insert for a PDC drill bit for subterranean drilling or forming boreholes in subterranean formations as defined in claim 17 comprising at least two cutting surfaces.

22. The insert for a PDC drill bit for subterranean drilling or forming boreholes in subterranean formations as defined in claim 17 wherein the plurality of cutters are immediately adjacent to and overlapping the center of the PDC drill bit.

23. The insert for a PDC drill bit for subterranean drilling or forming boreholes in subterranean formations as defined in claim 17 wherein the cutting surface further comprises a curved outer surface which extends from the edge to the apex.

* * * * *